United States Patent [19]

Wilkinson

[11] Patent Number: 4,951,432

[45] Date of Patent: Aug. 28, 1990

[54] FOLDING BUILDING STRUCTURE

[76] Inventor: Don G. Wilkinson, 32 S. Palm Ave., Sarasota, Fla. 34236

[21] Appl. No.: 441,524

[22] Filed: Nov. 27, 1989

[51] Int. Cl.[5] ..... E04B 1/32

[52] U.S. Cl. ..... 52/81; 52/79.5; 52/DIG. 10; 52/80

[58] Field of Search ..... 52/81, 82, DIG. 10, 52/80, 79.5

[56] References Cited

U.S. PATENT DOCUMENTS

| | | | |
|---|---|---|---|
| 3,332,178 | 7/1967 | Foster | 52/82 X |
| 3,640,034 | 2/1972 | Shotwell, Jr. | 52/81 X |
| 3,871,143 | 3/1975 | Quick | 52/82 X |
| 3,945,160 | 3/1976 | Grosser et al. | 52/82 X |
| 4,064,662 | 12/1977 | O'Toole | 52/81 X |
| 4,180,950 | 1/1980 | Foster | 52/81 |
| 4,413,452 | 11/1983 | Wikinson | 52/82 |
| 4,665,665 | 5/1987 | Wilkinson | 52/82 |
| 4,672,779 | 6/1987 | Boyd | 52/82 X |

*Primary Examiner*—David A. Scherbel
*Assistant Examiner*—Creighton Smith
*Attorney, Agent, or Firm*—Charles J. Prescott; Raymond H. Quist

[57] ABSTRACT

A folding building structure has a fixed roof formed by joining a plurality of identical triangles which have two equal side edges, a base edge and an apex opposite the base edge. All these apexes meet at a common point. To each roof base edge is hingedly joined the coextensive base edge of a wall triangle having two equal side edges. Each side edge of a wall triangle has hingedly joined thereto the hypotenuse edge of a right triangular wall panel. Each right triangular wall panel has a side edge equal to the height of the wall triangles having two equal side edges, and adjacent side edges of the right triangular wall panels are hingedly joined.

13 Claims, 2 Drawing Sheets

FOLDING BUILDING STRUCTURE

BACKGROUND OF THE INVENTION

1. Field of the Invention

This invention relates generally to building structures, and more particularly to a building structure having walls hingedly joined so that the structure may be folded into a more compact form.

2. Description of Related Art

In U.S. Pat. No. 4,413,452, I disclosed a building structure which was particularly useful because of the simple design which made it economical to produce. Because the design contemplates using as base materials wooden panels having a height which is twice the base (such as a ⅜ inch thick, 4×8 foot panel) and requires sawing each such panel diagonally, the fabrication is facilitated by having appropriate power driven saws available. Thus prefabrication of the building structure at a factory would make fabrication easier and quicker. Shipping of such prefabricated building structures, if made with the previously mentioned 4×8 foot panels, is somewhat awkward since the resulting structure is approximately 12 feet high.

The present invention discloses a structure of this type in which the walls may be folded to produce a package having a height of approximately 8 feet. Moreover, the shape of the folded package is such that it facilitates packing a plurality of the packages compactly.

SUMMARY OF THE INVENTION

In a preferred form of the invention, two kinds of triangular wooden panels are prepared from rectangular panels such as 4×8 foot panels. The first kind is the same as those disclosed in my previous patent, i.e. isosceles triangular panels having a base equal to the height. These are formed by diagonally sawing the rectangular panels into two pieces and joining two such pieces. (It should be noted that such rectangular panels typically have a side intended to be outside, and a side intended to be inside. Consequently, triangular panels from two different rectangular panels are used to produce an isosceles triangular panel having surfaces intended to be outside and inside.)

The second kind of triangular panel is a right triangular panel one of the two obtained by sawing a rectangular panel diagonally.

A pitched roof is formed by joining six isosceles triangular panels so that the six bases form the lower edges of the roof and the apexes opposite the bases meet at a common point. To each lower roof edge is hingedly joined the base of another isosceles triangular panel, thereby forming six isosceles triangular wall panels. In general, each side of each isosceles triangular wall panel has hingedly joined thereto the hypoteneuse of a right triangular wall panel. It will be found that the long side of each right triangular wall panel will be adjacent to the long side of another right triangular wall panel. These adjacent long sides are also hingedly joined. Typically an opening will be formed in one or more wall panels to provide access to the interior of the building structure. Alternatively, a wall panel may be omitted.

When rectangular panels having a height equal to twice the base are cut diagonally, the hexagonal roof naturally results, and the walls are formed without wasting any lumber. It is possible to vary the structure to obtain, for example, a pentagonal roof as I disclosed in U.S. Pat. No. 4,665,665. This results in some waste lumber.

It is therefore an object of this invention to provide a building structure which can be economically produced.

It is a further object of this invention to provide a building structure which can be folded into a more compact form for shipping.

It is an additional object of this invention to provide a building structure which when folded will enable compact packing.

In accordance with these and other objects, which will become apparent hereafter, the instant invention will now be described with reference to the accompanying drawings.

DETAILED DESCRIPTION OF THE INVENTION

Figure 2:
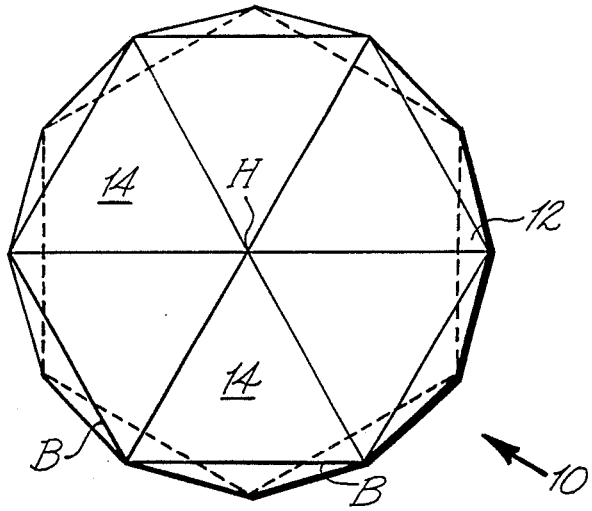
FIG. 2 is a plan view of the folding building structure of FIG. 1.
Figure 1:
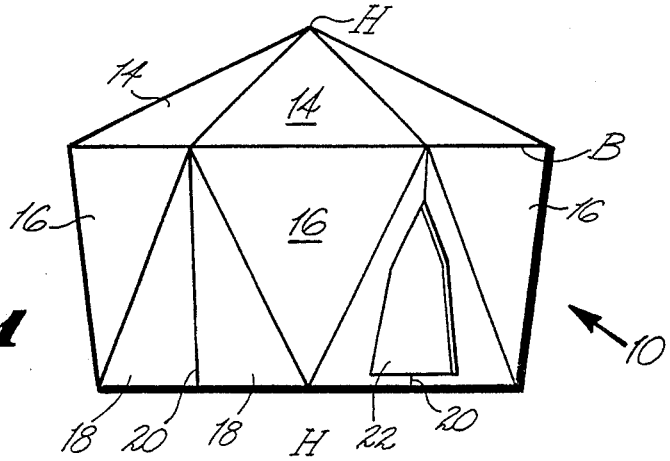
FIG. 1 is a front elevation view of a folding building structure in accordance with the invention.

Referring to FIGS. 1 and 2, folding building structure 10 is seen to have a pitched roof 12 formed of six joined isosceles roof panels 14. These panels are formed by sawing diagonally in half rectangular panels which preferably have a long side equal to two times the short side. In the United States there are commonly available wooden panels ⅜ inch thick and 4×8 feet. Such panels are suitable for use in making the invention, but it should be understood that rectangular panels of other dimensions may also be used. Moreover, as previously indicated, it is possible to make a roof with other than six triangular panels, with building sides similar in appearance, but different in number from those in the embodiment described.

The panels which have been sawed in half are fixedly joined so that the height of the isosceles triangular panels from the base B to the apex is X (or eight feet where a 4×8 foot panel is used). The base B also has a length X (or eight feet when the 4×8 foot panel is used).

As previously indicated, plywood is typically fabricated with one side intended to be outside and the other inside. Consequently, right triangular sections from two rectangular panels are preferably used in forming the isosceles triangular panels.

Although roof 12 is the same as that disclosed in U.S. Pat. No. 4,413,452, the walls of the folding building structure are formed differently. There is an isosceles triangular wall panel 16 having its base edge hingedly secured to the base edge of each isosceles roof panel 16. Hingedly secured to each side edge of isosceles triangular wall panel 16 is the hypoteneuse edge of a right triangular wall panel 18. As shown in FIG. 1, two such panels 18 abut and are hingedly joined along joint 20. When roof 12 is lifted, each joint 20 can be moved in by having a person pushing in on it. After these joints are moved in partially, the structure can be further folded by pushing in the bottoms of wall panels 16 until folding building structure 10 is in the configuration shown in FIG. 3.

As indicated in FIG. 1, one or more openings 22 are provide to give access to the interior of folding building structure 10.

Figure 3:
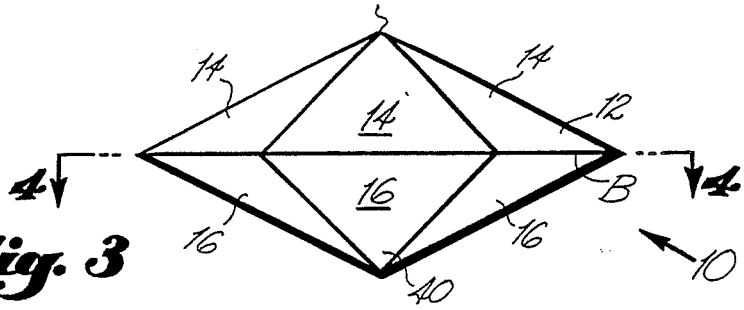
FIG. 3 is a front elevation view of the folding building structure of FIG. 1 in folded configuration.
Figure 4:
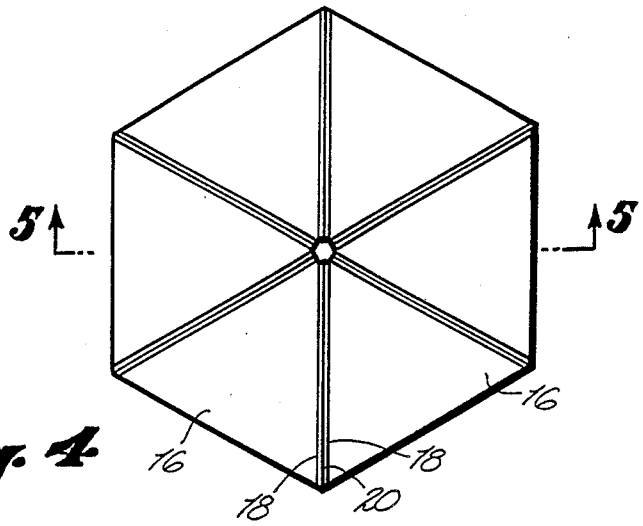
FIG. 4 is a plan view of the folded building structure taken on the line 4—4 of FIG. 3.
Figure 5:
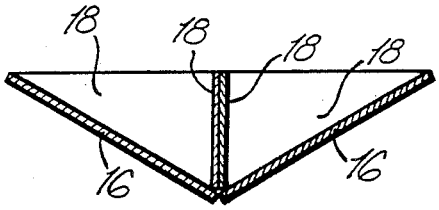
FIG. 5 is a cross-section elevation view taken on the line 5—5 of FIG. 4.

In FIG. 4, the folded wall of FIG. 3 is shown in plan view with roof 12 removed. Isosceles triangular wall panels 16 are shown together with right triangular wall panels 18. FIG. 5 further clarifies the arrangement.

Figure 6:
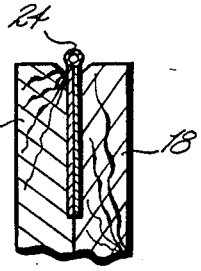
FIG. 6 is a cross-section detail view showing two panels in folded configuration.
Figure 7:
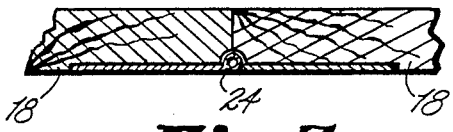
FIG. 7 is a cross-section detail view showing the two panels of FIG. 6 unfolded.

In FIG. 6 the juncture of two right triangular panels 18 is shown in the folded configuration with butt or piano hinge 24 in position. FIG. 7 shows the same juncture in the unfolded configuration.

Figure 8:
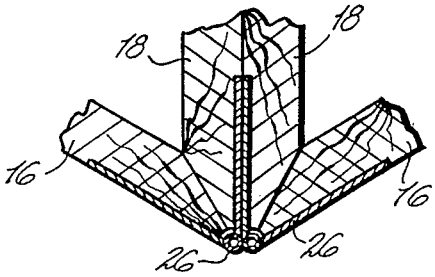
FIG. 8 is a cross-section detail view showing two additional panels in folded configuration.
Figure 9:
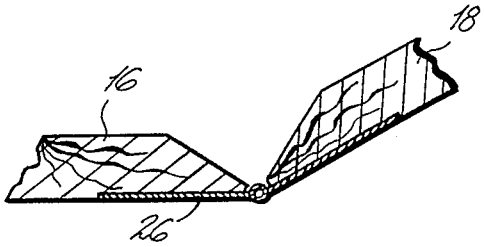
FIG. 9 is a cross-section detail view showing the two panels of FIG. 8 unfolded.

The juncture of isosceles triangular wall panel 16 and right triangular wall panel 18 formed by butt or piano hinge 26 is shown folded and unfolded in FIGS. 8 and 9. Mitering is used to avoid forcing the panels apart in the folded condition. The joint between roof panels 14 and wall panels 16 is similarly formed.

Figure 10:
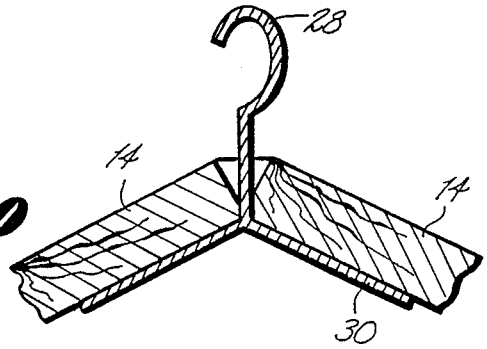
FIG. 10 is a cross-section detail view of the lifting device.

Turning to FIG. 10, at the common apex of roof panels 14 protrudes lifting hook 28 which is secured to dish-shaped support 30 secured to the inner surfaces of roof panels 14. When the structure is folded it can be held folded using for example, pin 40 (FIG. 3) which is passed through opposite panels 16 and temporarily secured.

It should be observed that the folded configuration reduces the height of the structure by approximately one third. It also permits compact packing of a plurality of such structures. This is important since a building built using four foot by eight foot panels is fourteen feet wide when unfolded - too wide to ship on highways. When folded, it is approximately eight feet high and so can be shipped by positioning it on its side.

When the folded building structures arrive at the destination where they are to be erected, a crane is used to support the structure at ground level while the fastening device is removed. The crane then slowly lifts the structure as it unfolds.

Flashing of metal, rubber or other material may be applied during fabrication or after the building is erected.

While the instant invention has been shown and described herein in what is conceived to be the most practical and preferred embodiment, it is recognized that departures may be made therefrom within the scope of the invention, which is therefore not to be limited to the details disclosed herein, but is to be afforded the full scope of the claims so as to embrace any and all equivalent apparatus and articles.

I claim:

1. A folding building structure comprising:

six isosceles triangular roof panels joined to form a roof;

each of said isosceles triangular roof panels having side edges, a base edge and an apex opposite said base edge;

said apexes of said triangular roof panels all meeting at a common point;

said base edge of each of said isosceles triangular roof panels having a length X and an altitude X;

six isosceles triangular wall panels, each having side edges, a base edge having a length X and an altitude X;

each isosceles triangular wall panel base edge being hingedly joined to one of said isosceles triangular roof panel base edges;

a plurality of right triangular wall panels each having a hypotenuse edge, a base edge having a length $\frac{1}{2}X$ and a side edge of length X;

each hypotenuse edge of said right triangular wall panels being hingedly joined to, and coextensive with, a said side edge of a said isosceles triangular wall panel;

at least some said side edges of said right triangular wall panels being hingedly secured to a said side edge of another of said right triangular wall panels.

2. A folding building structure in accordance with claim 1 further including:

at least one opening in at least one of said wall panels.

3. A folding building structure in accordance with claim 2 wherein:

said opening is in two adjacent wall panels.

4. A folding building structure in accordance with claim 1 further including:

lifting means secured to said roof, whereby said folding building structure can be raised.

5. A folding building structure in accordance with claim 1 wherein:

all of said panels are formed from 4×8 foot plywood panels cut diagonally in half.

6. A folding building structure in accordance with claim 1 wherein:

said hingedly joined panels are joined by piano hinges.

7. A folding building structure comprising:

a first plurality identical triangular panels joined to form a roof;

each of said triangular roof panels having two equal side edges, a base edge and an apex opposite said base edge; said apexes of said triangular roof panels meeting at a common point;

a second plurality, equal to said first plurality, of triangular wall panels, each of said triangular wall panels having two equal side edges, a base edge and an apex opposite said base edge;

each triangular wall panel base edge being hingedly joined to one of said triangular roof panel base edges;

a third plurality of right triangular wall panels each having a hypotenuse edge hingedly joined to, and coextensive with, a said side edge of a said triangular wall panel having two equal side edges;

each of said right triangular wall panels having a side edge and at least some of said right triangular wall panel edges being hingedly joined to a side edge of another right triangular wall panel.

8. A folding building structure in accordance with claim 7 further including:

at least one opening in at least one of said wall panels.

9. A folding building structure in accordance with claim 8 wherein:

said opening is in two adjacent wall panels.

10. A folding building structure in accordance with claim 7 further including:

lifting means secured to said roof, whereby said folding building structure can be raised.

11. A folding building structure in accordance with claim 7 wherein:

all of said panels are formed from 4×8 foot plywood panels cut diagonally in half.

12. A folding building structure in accordance with claim 7 wherein: said hingedly joined panels are joined by piano hinges.

13. A folding building structure comprising:

six isosceles triangular roof panels joined to form a roof;

each of said isosceles triangular roof panels having side edges, a base edge and an apex opposite said base edge;

said apexes of said triangular roof panels all meeting at a common point;

said base edge of each of said isosceles triangular roof panels having an eight foot length and an eight foot altitude;

six isosceles triangular wall panels, each having side edges, a base edge having an eight foot length and an eight foot altitude;

each isosceles triangular wall panel base edge being hingedly joined to one of said isosceles triangular roof panel base edges;

a plurality of right triangular wall panels each having a hypotenuse edge, a base edge having a four foot length and a side edge of eight foot length;

each hypotenuse edge of said right triangular wall panels being hingedly joined to, and coextensive with, a said side edge of a said isosceles triangular wall panel;

at least some said side edges of said right triangular wall panels being hingedly secured to a said side edge of another of said right triangular wall panels;

an opening formed in two joined right triangular wall panels;

lifting means joined to said roof.

* * * * *